United States Patent [19]

Stith

[11] Patent Number: 4,584,989

[45] Date of Patent: Apr. 29, 1986

[54] LIFE SUPPORT STRETCHER BED

[76] Inventor: Rosemarie Stith, 100-26 G Darrow Pl., Bronx, N.Y. 10475

[21] Appl. No.: 684,150

[22] Filed: Dec. 20, 1984

[51] Int. Cl.[4] ..... A61G 1/02

[52] U.S. Cl. ..... 128/1 D; 128/54; 128/419 D; 177/144; 296/20; 378/167; 378/209

[58] Field of Search ..... 128/1 R, 1 D, 54; 177/144; 269/322, 328; 296/20; 378/167, 209; 5/432

[56] References Cited

U.S. PATENT DOCUMENTS

| | | | |
|---|---|---|---|
| 1,725,030 | 8/1929 | Wantz | 378/209 |
| 1,907,054 | 5/1933 | Forst | 378/209 |
| 2,904,798 | 9/1959 | Heflin | 5/432 |
| 3,277,887 | 10/1966 | Thomas | 128/54 |
| 3,304,116 | 2/1967 | Stryker | 296/20 |
| 4,016,871 | 4/1977 | Schiff | 128/1 D |
| 4,352,991 | 10/1982 | Kaufman | 296/20 |
| 4,363,368 | 12/1982 | Paddon et al. | 177/144 |
| 4,365,344 | 12/1982 | Dornheim | 378/209 |

*Primary Examiner*—William E. Kamm

*Attorney, Agent, or Firm*—Kirschstein, Kirschstein, Ottinger & Israel

[57] ABSTRACT

A life support stretcher bed includes an undercarriage which is supported on the ground for movement from one location to another by respective wheels which are commonly lockable by a braking mechanism to prevent movement of the undercarriage from a selected location. A platform is supported on the undercarriage for raising and lowering relative thereto by means of a hydraulically operating lifting arrangement which includes a control arrangement mounted on the undercarriage. An intraaortic balloon pump unit that is supported on the ground by respective casters for movement in any direction along the ground is connected to the undercarriage for shared movement therewith at a predetermined distance from the undercarriage. The platform includes straps for holding the patient supported in a supine position on the platform in such position, and side rails which can be moved from a position above the platform into an out-of-the way position. The undercarriage further has a set of drawers for medical supplies and implements, a shelf for temporary resting of the supplies and implements to be used for the particular patient, an oxygen bottle, a weighing device, a power pack and a Swan and an A-line transducer mounted thereon, while the platform carries a shelf which supports a defibrillator, and a plurality of upright rods having fingers for suspending intravenous fluid bottles and similar equipment therefrom. An X-ray cassette can be inserted from the side into a slot of the undercarriage. The platform has a window receiving a plate that supports the chest of the patient and that can be lifted out of the window by a rack-and-pinion drive.

6 Claims, 6 Drawing Figures

LIFE SUPPORT STRETCHER BED

BACKGROUND OF INVENTION

The present invention relates to beds and stretchers in general and more particularly to such used to accommodate patients in intensive or cardiac care units in hospitals.

Most well equipped modern hospitals have intensive care units and/or cardiac care units (hereafter collectively referred-to only as intensive care units) for the treatment of patients requiring constant care and monitoring. Although originally used primarily for victims of heart attack and similar life-threatening heart and other circulatory problems, these units have been also adapted for the treatment of patients suffering from other types of illnesses and traumatic injuries, who are in critical condition or otherwise require intensive care, treatment and monitoring.

In the typical intensive care units, patients lie on ordinary hospital beds which are equipped with wheels having manually settable brakes, and with side rails slidably attached to the bed frame which may be raised and locked into position to prevent the patient from rolling off the bed. The intensive care unit patient differs from many ordinary hospital patients in that, because of the need for constant monitoring of his or her vital signs and other body functions, he or she is often to be physically linked to, or to be situated in the physical proximity, of numerous monitoring devices, for example, arterial line transducers, transducers, electrocardiographs, temperature monitoring devices or the like. Furthermore, the intensive care unit patient often is connected to one or more intravenous or intra-arterial lines for the administration of nutrients and/or medication, and may also be administered oxygen or other gases, e.g. through a mask placed over his or her face.

In addition to the monitoring and therapeutic devices which an intensive care unit patient may be linked to on a longterm basis, there are other items of equipment which must generally be kept in the proximity of the patient for use in emergency situations, which may occasionally arise. Such emergency equipment includes, for example, intra-arterial balloon pumps (IABP) and defibrillators. These items of emergency equipment are kept in the intensive care unit room but must be wheeled over to the patient's bed when the emergency situation arises and must be brought adjacent to the bed for operative use, frequently among a crowded tangle of other instruments and flow lines linked to the patient.

Moreover, intensive care unit patients are frequently in need of medication administered periodically (such as by parenteral injection) as part of routine therapy or administered in emergency situations. An intensive care unit patient may often be administered several different medications in a single day and the medications normally must be brought over to the patient by a nurse or other health care professional on a hand trolley which must be placed adjacent to the bed and then removed after the medication has been administered.

The conventional hospital bed currently used in most intensive care units is not well adapted for the conditions encountered in such units. Such a bed does not have ordinarily mounting accessories or receptacles for the orderly and space-saving attachment of monitoring devices and flow lines (together with their liquid and gas reservoirs such as bottles, bags or tanks). The known bed also does not accommodate emergency care devices such as defibrillators in a particular designated location or mounting area that health care personnel could immediately turn to and have the correct emergency device at hand when the need arises. Moreover, such a customary bed also does not have associated with it adequate shelf or drawer space for medication, syringes and other supplies such as sponges, alcohol wipes, small monitoring components such as transducers, and the like. The bed of conventional design also generally does not have associated with it portable power sources to supply power to the various electrical instruments which surround the intensive care unit patient.

Intensive care unit patients frequently must be taken out of the intensive care unit area and transported to another area of the hospital, e.g., for diagnostic purposes or for surgery. In such cases, what is conventionally done is to transfer the patient from his or her hospital bed to a wheel-mounted stretcher or gurney, and the patient is then transported to the x-ray room, operating room and so on. Once the patient arrives at the destination area, he or she usually must be transferred once again from the stretcher to the bed or table used in that area. These transfers are very difficult and sometimes quite dangerous as they are often performed with unconscious or semiconscious patients who are being transferred together with intra-arterial and intravenous lines as well as oxygen sources, monitoring transducers and other devices to which they must remain connected. This makes the transfer process extremely cumbersome and time consuming at best and frequently risky to the patient's well-being.

Attempts have been made in the past to modify conventional hospital beds or stretchers to solve some of the abovementioned drawbacks. However, these modified beds were not designed specifically for intensive care units in most instances and do not solve a great majority of the space and convenience defects created by conventionally used beds. For example, in U.S. Pat. No. 2,904,798, a hospital bed with multipurpose equipment is shown which includes a "bed chair" arrangement whereby a back rest is attached to the foot of the bed which can support the patient in a seated position on the mattress; a table mounted on the bed frame at the side of the bed for medication, instrumentation and the like; a slidably mounted drawer under the bed, and an extendable footrest. In U.S. Pat. No. 3,304,116, there is shown a wheeled "carriage" for supporting a patient, which carriage includes such attachments as a fifth wheel located near the center of the undercarriage to prevent drifting of the carriage while moving, a hydraulic height-adjusting mechanism, a side rail which converts into a partial shelf when folded down parallel to the bed surface and brackets for mounting an oxygen tank and a basket for necessary equipment and medications.

The apparatus disclosed shown in U.S. Pat. No. 3,818,516 is specifically designed to facilitate x-ray examinations in order to avoid having to lift and maneuver the patient from a bed to a mobile stretcher and then onto an x-ray table. The bed includes a mattress transparent to x-rays and an extendable upper bed section which may be displaced longitudinally forward from the rest of the bed so that the upper part of the patient's body may be x-rayed with a conventional x-ray apparatus.

Although the above-discussed prior art hospital beds or stretchers are somewhat more useful in an intensive care unit than the conventional hospital bed without accessories, they do very little to solve most of the drawbacks mentioned above. Even combining all of the features of these prior art devices which would be quite difficult because of their great disparate structures, no means would be provided for the space accommodation problem or the monitoring and other devices surrounding the patient, nor for the accomodation of emergency devices, nor for supplying power sources for all the necessary instrumentation. Furthermore, no mounting components are provided in these prior art devices for intravenous and intra-arterial lines, for monitoring transducers for IABP's, and the like.

Recently, certain beds specifically designed for critical care patients, such as intensive care unit patients, have been marketed. The most advanced of such beds includes a built-in hydraulically controlled adjuster for the bed top; a centered fifth wheel to prevent drift and large, carpet castered wheels for better control, particularly at high speeds; an adjustable Fowler panel under the upper portion of the bed mattress which can be actuated to raise the upper portion of the patient's body almost to a sitting position for x-ray and fluoroscopy purposes. This Fowler panel has an x-ray cassette holder built in to facilitate the taking of x-rays right in the bed. In addition, this critical care bed includes a built-in weight monitoring system for in-bed patient weighing and a removable headboard and footboard to gain immediate access to the patient in an emergency. Although this recently introduced critical care bed does embody certain features useful in an intensive care unit setting, it is almost devoid of space/accomodation features such as mounting attachments or instrumentation, intravenous lines, etc. as well as for emergency equipment and does not provide shelf and drawer space for equipment, medication and instruments. Moreover, no internal power source for connection to peripheral instrumentation used in the intensive care unit is provided. Moreover, although the Fowler panel enables the performance of x-ray procedures on the upper portion of the patient's body if the patient can be raised to a near-sitting position, there is no way to x-ray the body of a patient in the prior art bed who must remain in a prone position because the x-ray cassette cannot be inserted into the panel if it is not raised.

In short, no bed or stretcher has been provided in the prior art which is well adapted for use in intensive care units which solves all of the aforementioned problems and drawbacks with conventional and special design prior art beds.

SUMMARY OF THE INVENTION

It is an object of the present invention to provide a life support stretcher bed for use with critical care patients that overcomes the aforementioned drawbacks of the prior art.

An additional object of the present invention is to provide a life support stretcher bed as described above which creates a space-saving organized environment for the accommodation of much of the peripheral equipment and instrumentation used in intensive care units.

A further object of the present invention is to provide a life support stretcher bed of the type here under consideration which obviates the need for removing or transferring the patient to another stretcher or table for x-ray purposes and for transportation to the operating room or other hospital areas.

Still another object of the present invention is to provide a life support stretcher bed of the above type which incorporates power sources to supply power to electrical instrumentation surrounding the bed so that this instrumentation may be kept operative even when the bed is out of the proximity of stationary wall outlets.

Yet further object of the present invention is to provide a life support stretcher bed which incorporates a variety of features designed to protect the patient's welfare and enable the efficient and rapid administration of ordinary and emergency care to the patient in all situations.

In keeping with these objects and others which will become apparent hereinafter, the present invention resides, briefly stated, in a novel life support stretcher bed which comprises an undercarriage including a support structure and a plurality of wheels by means of which the support structure is supported on the ground for movement from one location to another; a platform mounted on the undercarriage and adapted to support a patient in a supine position; an intra-aortic balloon pump unit having a plurality of casters supporting the same on the ground for movement in any direction along the plane of the ground; and means for connecting the intra-aortic balloon pump unit to the undercarriage for movement therewith on the ground between the locations at a constant distance from the undercarriage. The life support stretcher bed further comprises of means for mounting the platform on the supporting structure for movement in the vertical directions, and pressurized medium operated lifting means operative for lifting and lowering the platform relative to the undercarriage and for holding the platform at the desired elevation with respect to the undercarriage.

In this connection, it is particularly advantageous when the lifting means includes a control arrangement for controlling the lifting, lowering, and holding action of the lifting means, and means for mounting the control arrangement on the undercarriage.

According to a further advantageous aspect of the present invention, the life support stretcher bed further includes means for monitoring the weight of the patient supported on the platform, the monitoring means being supported on the undercarriage; a set of drawers mounted on the undercarriage and operative for accommodating medications and implements expected to be used during the life support activities with respect to the respective patients supported on the platform during a predetermined period of use of the bed; and straps for tying the respective patients to the platform during the life support activities.

According to a further aspect of the present invention, the life support stretcher bed includes side rails mounted on the sides of the platform for displacement between their active positions in which they extend above the platform, and their inactive positions in which they are removed from the area above the platform. Advantageously, the life support stretcher bed further includes at least one shelf connected to the platform at the area of the patient's head, and a defibrillator unit supported on the shelf; at least one oxygen tank mounted on the undercarriage; at least one power pack mounted on the undercarriage; and a Swan and A-line transducer mounted on the undercarriage.

According to a further facet of the present invention, the life support stretcher bed further includes at least one additional shelf arranged at the side of the bed and operative for supporting medical supplies and implements needed during the life support activities with respect to the respective patient.

It is especially advantageous when the life support stretcher bed further includes hollow stub shafts arranged at the corners of the platform and extending vertically therefrom, and upright support rods having lower ends received in the hollow stub shafts, and upper ends carrying respective fingers for suspending intravenous fluid containers and other medical equipment of similar nature therefrom.

According to a further aspect of the present invention, it is advantageous when the platform has a window arranged at the chest area of the patient supported on the platform in a supine position, and a support plate substantially fittingly received and supported in the window; and further comprising means for lifting the support plate and the chest area of the patient resting thereon a predetermined distance over the platform for performing reviving manipulations of the chest area of the patient.

In this connection, it is particularly advantageous when the lifting arrangement for the plate includes a rack-and-pinion drive, and an U-shaped bracket secured to the rack of the drive, and to the plate, the pinion of the drive being rotatably mounted on the undercarriage and meshing with the rack.

The various features incorporated into the novel life support stretcher bed make it an extraordinary space-saving, time-saving and work-saving patient support. Furthermore, the ability to create an environment around the intensive care unit patient which makes it extremely convenient to obtain and use all necessary equipment and supplies, and the ability to perform x-rays and other procedures on the patient and transport the patient from one location to another without having to shift him or her from the bed to a stretcher or other transport means is of great value in patient care and may be vital in life-threatening emergency situations.

The novel features which are considered as characteristic of the invention are set forth in particular in the appended claims. The improved life support stretcher bed itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMODIMENT

Figure 1:
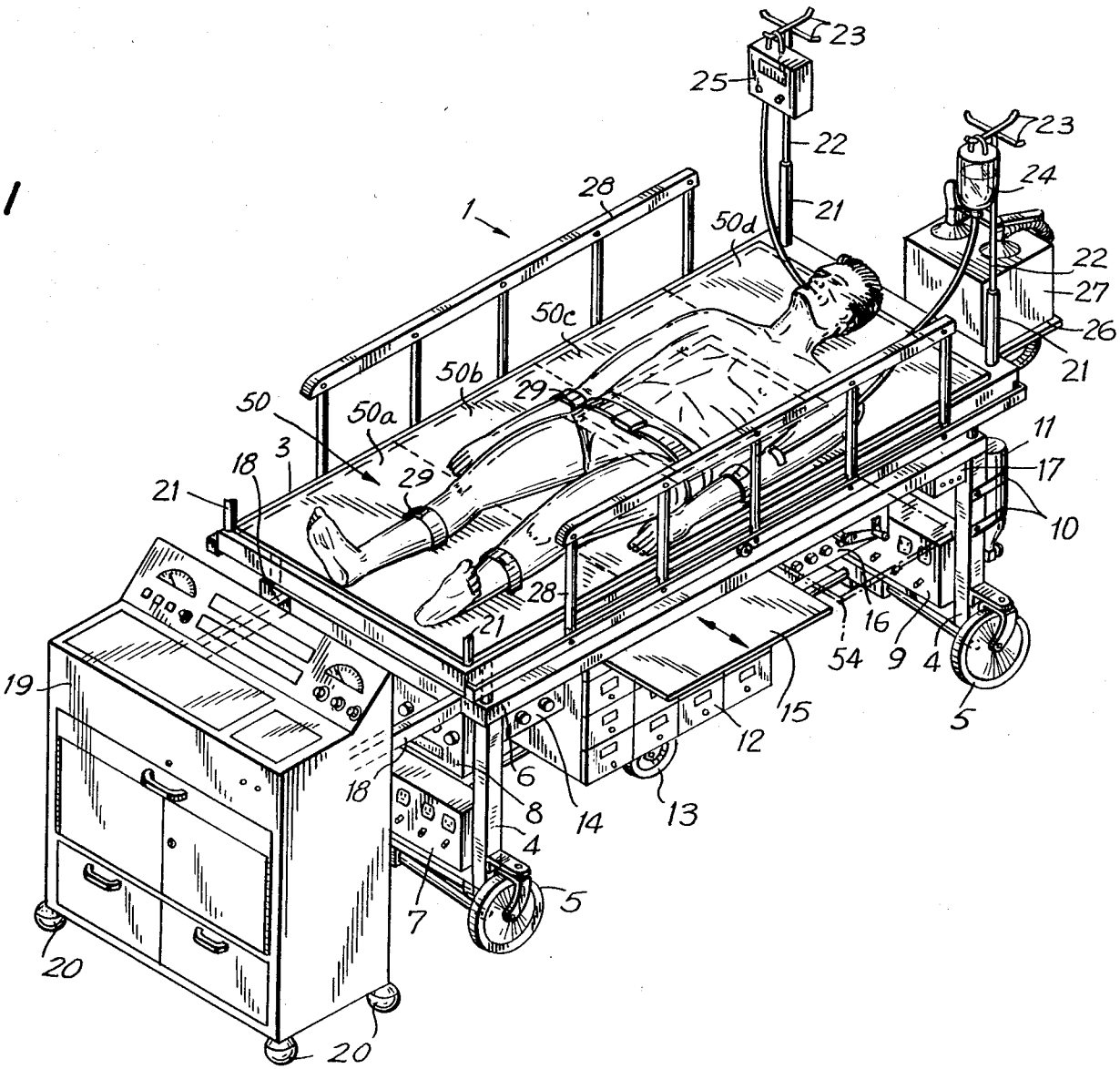
FIG. 1 is a perspective view of a life support stretcher bed according to the present invention with a patient in a supine position thereon.

Referring now to the drawing in detail, and first to FIG. 1 thereof, it may be seen that the reference numeral 1 has been used therein to identify a life support stretcher bed according to the present invention in its entirety. The life support stretcher bed 1 includes, as its main components, an undercarriage 2 and a platform 3 which is supported on the undercarriage 2 in a manner which will be discussed in more detail later, so that it extends along a substantially horizontal plane to support a patient in a supine position. The undercarriage 2 includes four upright legs 4 which have wheels or casters 5 mounted with freedom of rotation about their respective horizontal axes, and with freedom of angular displacement about respective vertical axes. The legs 4 are interconnected at their respective upper ends by a connecting structure 6 which can be constructed as a frame or as a plate.

The undercarriage 2 carries, at one of its ends and between the front legs 4, a battery-powered power pack 7 and a weight-monitoring system 8 which is constructed to make it posible to monitor the patient while supported on the platform 3. At its other end, and between the remaining two rear legs 4, the undercarriage 2 carries a reserve power pack 9 and, via respective holders 10, at least one tank or bottle, especially an oxygen tank 11. Substantially centrally between the above-mentioned pairs of legs 4, the undercarriage 2 is provided with a set of drawers 12 for medications, supplies and other needs. A fifth wheel 13 is mounted on the undercarriage 2 below the drawer set 12 and serves to improve steerability of the life support stretcher bed 1 while the latter is being moved from one location to another. The undercarriage 2 is further provided with a hydraulic control arrangement 14 which enables the attending personnel to position the patient supported on the platform 3 by changing the position of the platform 3, with an extendable shelf 15 for temporarily holding medical supplies, utensils of surgical implements, tools or accessories, with a Datascope telemetry equipment 16 and with a Swan and A-line transducer 17.

The connecting structure 6 has attached thereto a pair of substantially horizontally extending connecting bars or rails 18, to which there is connected an intra-aortic balloon pump 19 which is provided with casters 20. Because of this connection, the intra-aortic ballon pump 20 can be moved from one place to another with the life support stretcher bed l, in a constant position relative to the latter. However, such connection to the bars or rails 18 is preferably detachable, so that the intra-aortic balloon pump 19 can be dissociated from the stretcher bed 1 and carted away if not needed. In the absence of the unit 19, access to the power pack 7 and to the weight-monitoring system 8 is improved. Yet, such access may still be had even if the unit 19 is connected to the bars or rails 18, since the rails or bars 18 keep the unit 19 at a distance from the stretcher bed 1. An additional advantage of this expedient is that the unit 19 is kept at a distance from the platform 3 and thus from the feet of the patient, so that the patient cannot brace himself against the back side of the unit 19 and possibly damage the latter.

The platform 3 is provided at its corners with four upright stub shafts 21 which are tubular or otherwise hollow to receive respective lower ends of support rods 22 as needed. As shown, the support rods 22 are each provided with four substantially hookshaped generally horizontally extending fingers 23 spaced from one another by 90°. As illustrated, one of the fingers 23 of one of the support rods 22 has an intravenous feeding device 24 suspended therefrom, while one finger 23 of the other support rod or pole 22 carries a blood pressure monitoring apparatus or similar equipment 25. Another shelf 26 is mounted on the platform 3 at the region of the patient's head, and supports a defibrillator or other apparatus 27. The platform is further provided with side rails 28 which can be folded down if desired, and restraining straps 29 which can be used to tie the patient to the platform 3.

Figure 3:
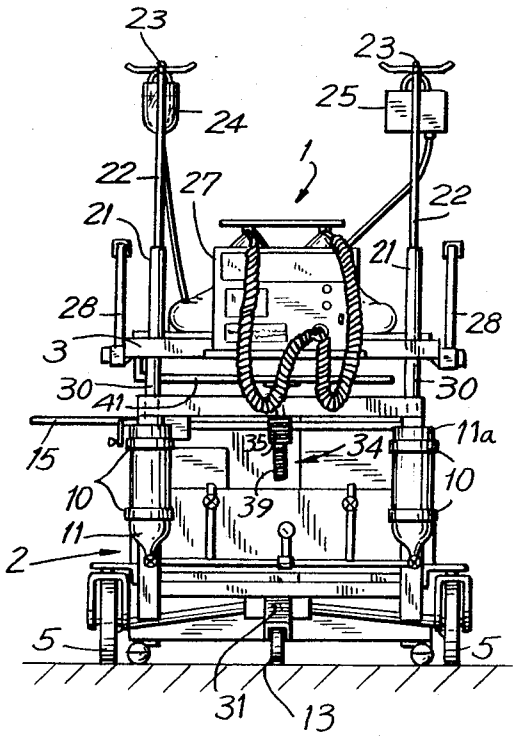
FIG. 3 is an end elevational view of the head end of the life support stretcher bed of FIG. 1.
Figure 2:
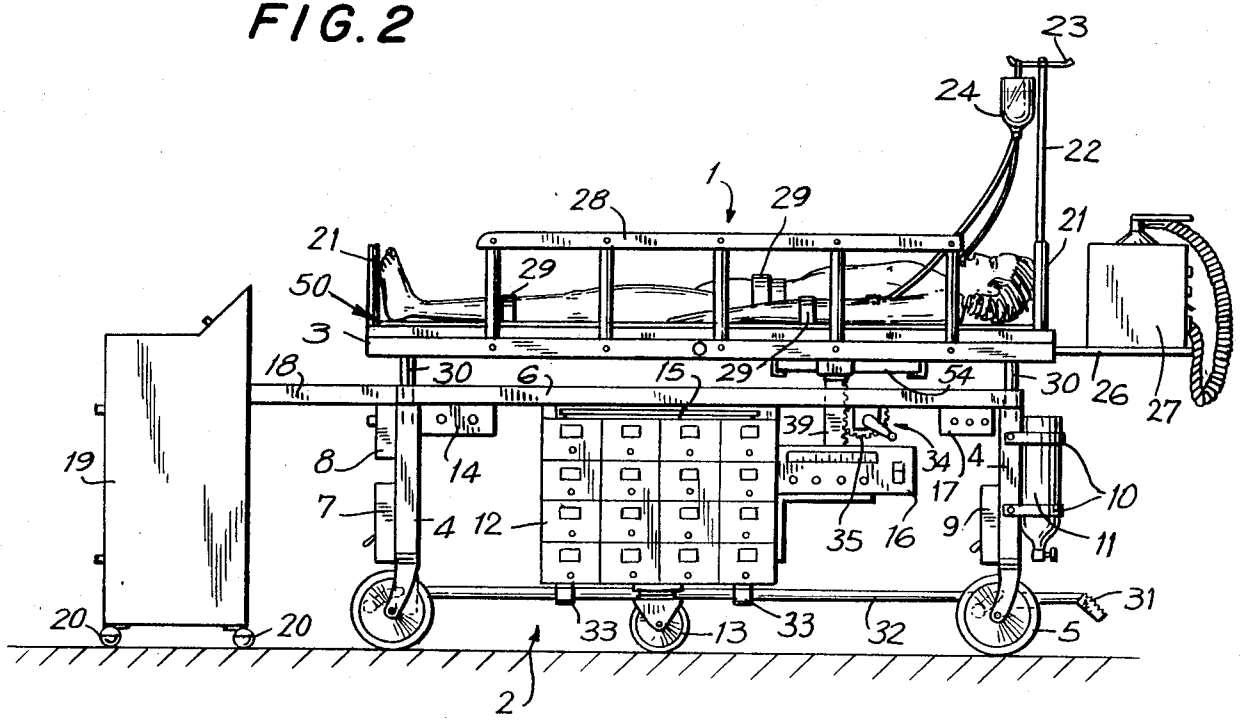
FIG. 2 is a side elevational view of the life support stretcher bed of FIG. 1.

Additional details of the stretcher bed 1 can be observed in FIGS. 2 and 3. So, for instance, it may be seen that the platform 3 is supported on the undercarriage 2 by means of supporting rods 30. These rods 30 are partially accommodated in the respective legs 4 which are made hollow for this purpose. Advantageously, the legs 4 are constructed as, or accommodate, respective cylinders of hydraulic cylinder-and-piston units which further include respective pistons received in the cylinders and connected to the respective rods 30. Such cylinder-and-piston units are then hydraulically connected, by means of respective hydraulic lines which have been omitted from the drawing in order not to unduly clutter the same, to the hydraulic control arrangement 14 which then controls the admission of a pressurized hydraulic medium to, and the discharge of such medium from, the respective hydraulic cylinder-and-piston units, resulting in lifting or lowering of the platform 3 as desired.

FIG. 2 also shows that the stretcher bed 1 includes a wheel braking system which includes an actuating pedal 31 and transmission rods 32 that are guided on the underside of the drawer set 12 in respective sleeve-shaped guides 33. The braking system is of a well known construction, the details of which need not be discussed here. Suffice it to say that the wheel braking system is constructed to lock the wheels 5 situated close to the actuating pedal 31 directly, and the wheels 5 remote from the pedal 31 via the transmission rods 32, all substantially at the same time. This renders it possible to assure that the stretcher bed 1 will not move away from the selected position when the wheels 5 are locked. Yet, when the wheel braking system is released, it is possible to move the stretcher bed 1 to any other location with relatively little effort.

Figures 4, 5, 6:
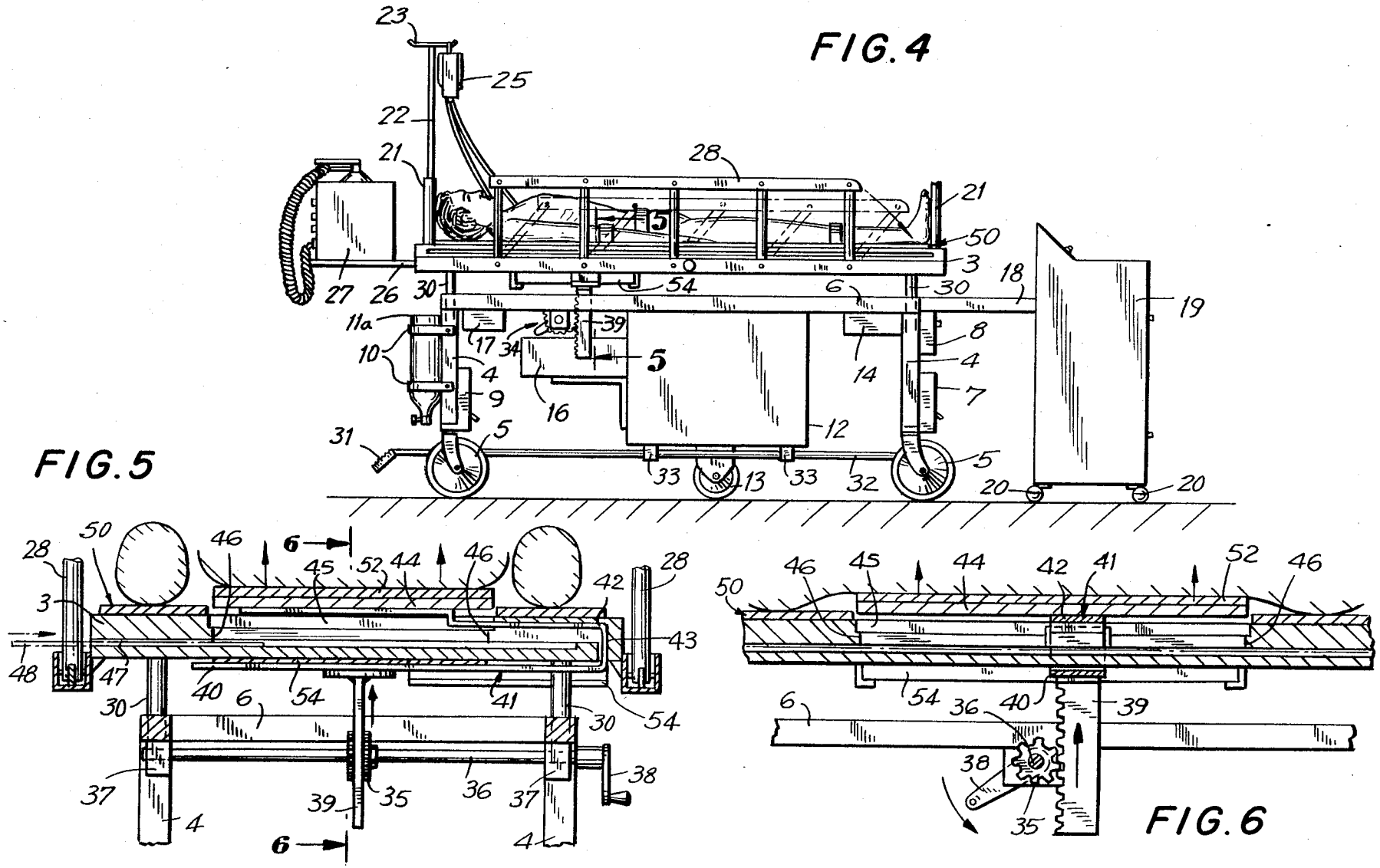
FIG. 4 is a side elevational view showing the side of the life support stretcher bed of FIG. 1 opposite to that shown in FIG. 2.
FIG. 5 is a sectional view taken along line 5—5 of FIG. 4.
FIG. 6 is a sectional view taken along line 6—6 of FIG. 5.

It is also shown in FIGS. 2 and 4, and in more detail in FIGS. 5 and 6, that the stretcher bed 1 is further equipped with a rack-and-pinion lifting arrangement 34. The lifting arrangement 34 includes a pinion 35 which is mounted on a shaft 36 for joint rotation therewith, the shaft being mounted for rotation in respective lugs 37 secured to the connecting structure or frame 6 at the underside of the latter. The shaft 37 can be rotated about its longitudinal axis by means of a crank 38. The pinion 35 meshes with a rack 39 which is secured to a lower arm 40 of a generally U-shaped bracket 41 which further includes an upper arm 42 and an interconnecting portion 43 which interconnects the upper and lower arms 40 and 42 and keeps them substantially parallel to one another. To this end, the bracket 41 is of a material and of a thickness such that it has a high rigidity, that is, that only minimum, if any, movement of the arms 40 and 42 is possible when external forces are applied thereto. A support plate 44 is rigidly connected to the upper arm 42 of the bracket 41. The plate 44 fits into a window 45 of the platform 3 and is supported therein, substantially flush with the upper surface of the platform 3, on shoulders 46 which extend around the opening 45, when the rack 39 is in its lower position. On the other hand, as the rack approaches its upper position, as shown in FIGS. 5 and 6, the U-shaped bracket 41 is displaced upwardly, and with it the plate 44, until it leaves the window 45 and supports the chest area of a patient resting in a supine position on the platform 3 at a distance above the platform 3 as needed for applying periodic pressure against the chest during revival efforts.

FIG. 5 also shows that the platform 3 is provided with a slot 47 into which an X-ray or fluoroscopy cassette 48 can be introduced from the side of the stretcher bed 1, as indicated in phantom lines, when it is desired to conduct an X-ray/fluoroscopy examination of the patient. It will be appreciated that the X-ray/fluoroscopy machine is then positioned above the patient and aimed through the area to be X-rayed/fluoroscoped against the cassette 47. Thus, the patient can be X-rayed/fluoroscoped without being moved to a sitting position or removed from the stretcher bed 1.

Still another feature resides in providing a generally rectangular thin mattress 50 above the platform to comfortably support the patient. Advantageously, the mattress is made of a firm, resilient material such as foam or sponge rubber, and is permeable to X-rays. In order to enable the lifting arrangement 34 to elevate the plate 44 and, hence, the chest area of the patient without unduly deforming the mattress, the mattress comprises a main section which is cut out in the region of the chest area of the patient, and a separate auxiliary section 52 (see FIGS. 5 and 6) which is received in the cutout. The auxiliary section 52 is located on the plate 44 and moves jointly with the same. The mattress could also be formed of discrete multiple sections **50*a*, 50*b*, 50*c*, 50*d* (see FIG. 1) wherein the chest section 50*c* is free to move in the vertical directions relative to the remaining sections. Of course, if the mattress is thin or pliant enough, it can be made of one piece, or can be comprised of multiple sections stitched together along folding lines to permit the plate 44** to be raised without unduly distorting the mattress or creating discomfort for the patient.

For background contrast during X-raying and/or fluoroscopy, a surface coating 54 (see FIG. 5) is applied to the arm 40 underneath the inserted cassette 48 to provide a proper background contrast.

Yet another feature is embodied in mounting an auxiliary shelf 54 for sliding movement underneath the frame 6 between an extended position, shown in dashed lines in FIG. 1, to a retracted position. In the extended position, the shelf 54 is located at the side of the bed in the region of one of the patient's outstretched arms. Should the need arise to firmly support the patient's outstretched arm, e.g. during the administration of a medicine or during the measurement of a body function, the arm can be laid on the extended shelf 54.

As described, this invention resides in a self-contained, self-powered, mobile, life support stretcher bed for critically ill patients requiring intensive care, treatment and monitoring with the aid of electrically powered medical devices, medical supplies, implements and the like. The power packs or series taps 7 and 9 each comprise a plurality of electrical outlets which are arranged at a plurality of locations in the circumambient region of the undercarriage. The outlets are readily accessible to electrical plugs of the various medical devices. Thus, for example, the defibrillator 27, the Swan and the A-line transducers 17, the Datascope telemetry device 16, etc. may advantageously have their respective plugs connected to the outlets of power pack 9, which is located in the vicinity of this equipment, in order to prevent tangling of their power cords and, of course, to provide a readily available power tap. The balloon pump 19, the weight device 8, the hydraulic controls 14 may advantageously have their respective plugs connected to the outlets of power pack 7, which is located in the vicinity of this equipment, for the same purpose of preventing power cords from becoming intertwined and providing a readily available power tap. The power packs 7 and 9 advantageously have a rechargeable battery.

In addition, the various shelves 26, 54, 15; the support poles 22; the drawer set 12; the brackets 10; the support bars 18; and the platform all serve as readily available supports in the circumambient region of the undercarriage on which the aforedescribed medical devices, medical supplies, instruments, etc. are conveniently mounted.

In effect, the critically ill patient is surrounded in a complete, space-saving, organized intensive care environment which is dedicated to care for, treat and monitor the patient with speed and efficiency in ordinary and emergency situations, not only when the bed is stationary, but also during patient transport.

Equipment other than that specifically mentioned herein can also be mounted on the bed. By way of nonlimiting example, suction and vacuum pumps may be mounted on the undercarriage and may be removed therefrom as desired to deal with aspiration situations wherein fluid must be removed from a patient's breathing passages.

It will be expressly understood that the stretcher bed described herein can be used not only as a bed in a patient's room in a critical care area, but also can be used in any room where testing, monitoring or caring takes place, e.g. a cardiac catheterization room, or as an operating table in an operating room and, of course, as a transport dolly during transport of the patient from place to place.

It will be understood that each of the elements described above, or two or more together, may also find a useful application in other types of arrangements differing from the type described above.

While the invention has been illustrated and described as embodied in a life support stretcher bed for use in intensive care units or emergency rooms of hospitals, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A self-contained, self-powered, mobile, life support stretcher bed for critically ill patients requiring intensive care, treatment and monitoring with the aid of electrical medical devices powered by flexible electrical cables terminating in electrical plugs, medical supplies and implements, said bed comprising:

(a) an undercarriage including a support structure and a plurality of wheels by means of which the support structure is supported on the ground from one location to another;

(b) a platform mounted on said undercarriage and adapted to support a patient in a supine position;

(c) an electrical power source mounted on the undercarriage, said power source having a plurality of identical electrical outlets arranged at a plurality of exterior readily accessible locations in the circumambient region of the undercarriage to provide readily accessible power taps to desired ones of which any electrical plug of the respective medical devices is connected; and (d) support means mounted on the undercarriage and having a plurality of support members arranged at a plurality of locations in the circumambient region of the undercarriage to provide readily available supports onto desired ones of which the respective medical devices, medical supplies and implements are mounted, whereby a complete space-saving, organized intensive care environment is created for the patient to whom ready access is available.

2. A life support stretcher bed, comprising:

an undercarriage including a support structure and a plurality of wheels by means of which the support structure is supported on the ground from one location to another;

a platform mounted on said undercarriage and adapted to support a patient in a supine position;

a window in said platform and arranged at the chest area of the patient supported on the platform in a supine position;

a support plate substantially fittingly received and supported in said window;

means for lifting said support plate and the chest area of the patient resting thereon a predetermined distance over the platform, and at a higher elevation than the head area of the patient for performing cardiopulmonary resuscitation reviving manipulations of the chest area of the patient with the head area lowered relative to the chest area.

3. The life support stretcher bed as defined in claim 2, and further comprising a mattress mounted on said platform for supporting the patient, said mattress having a main section formed with a cutout above said support plate, and a discrete auxiliary section mounted in said cutout and jointly liftable with said support plate.

4. A life support stretcher bed, comprising:

(a) an undercarriage including a support structure and a plurality of wheels by means of which the support structure is supported on the ground for movement from one location to another;

(b) a platform mounted on said undercarriage and adapted to support a patient in a supine position;

(c) means for mounting said platform on said supporting structure for movement in the vertical direction;

(d) pressurized medium operated lifting means operative for lifting and lowering said platform relative to said undercarriage and for holding said platform at the desired elevation with respect to said undercarriage, said lifting means including a control arrangement for controlling the lifting, lowering, and holding action of said lifting means, and means for mounting said control arrangement on said undercarriage;

(e) means for monitoring the weight of the patient supported on said platform, said monitoring means being supported on said undercarriage;

(f) a set of drawers mounted on said undercarriage and operative for accommodating medications and implements expected to be used during the life support activities with respect to the respective patients supported on said platform during a predetermined period of use of the bed;

(g) straps for tying the respective patients to the platform during the life support activities;

(h) side rails mounted on the sides of said platform for displacement betweeen their active positions in which they extend above the platform, and their inactive positions in which they are removed from the area above the platform;

(i) at least one shelf connected to said platform at the area of the patient's head, and a defibrillator unit supported on said shelf;

(j) at least one oxygen tank mounted on said undercarriage;

(k) at least one power pack mounted on said undercarriage;

(l) a Swan and an A-line transducer mounted on said undercarriage;

(m) at least one additional shelf arranged at the side of said bed and operative for supporting medical supplies or the patient's arm needed during the life support activities with respect to the respective patient;

(n) hollow stub shafts arranged at the corners of the platform and extending vertically therefrom, and upright support rods having lower ends received in said hollow stub shafts, and upper ends carrying respective fingers for suspending intravenous fluid containers and other medical equipment of similar nature therefrom;

(o) said platform being provided with a slot into which a film cassette is insertable from the side of said platform to a position underneath the chest area of the patient supported on the platform in a supine position, and from which slot the cassette is removable without moving the patient;

(p) an intraaortic balloon pump unit having a plurality of casters supporting the same of the ground for movement in any direction along the plane of the ground; and (q) means for connecting said intraaortic balloon pump unit to said undercarriage for movement therewith on the ground between said locations at a constant distance from said undercarriage.

5. A life support stretcher bed, comprising:

(a) an undercarriage including a support structure and a plurality of wheels by means of which the support structure is supported on the ground for movement from one location to another;

(b) a platform mounted on said undercarriage and adapted to support a patient in a supine position, said platform having a window arranged at the chest area of the patient supported on the platform in a supine position, and a support plate substantially fittingly received and supported in said window;

(c) means for lifting said support plate and the chest area of the patient resting thereon a predetermined distance over the platform for performing reviving manipulations of the chest area of the patient;

(d) an intraaortic balloon pump unit having a plurality of casters supporting the same of the ground for movement in any direction along the plane of the ground; and (e) means for connecting said intraaortic balloon pump unit to said undercarriage for movement therewith on the ground between said locations at a constant distance from said undercarriage.

6. The life support stretcher bed as defined in claim 5, wherein said lifting means for said plate includes a rack-and-pinion drive, and an U-shaped bracket secured to the rack of said drive, and to said plate, the pinion of said drive being rotatably mounted on said undercarriage and meshing with said rack.

* * * * *